United States Patent [19]

Ruge

[11] 4,129,399

[45] Dec. 12, 1978

[54] MOUNTING BARS FOR ROAD MAKING MACHINES

[75] Inventor: Hans Ruge, Wardenburg, Fed. Rep. of Germany

[73] Assignee: Firma Klaus-Gerd Hoes, Wardenburg, Fed. Rep. of Germany

[21] Appl. No.: 851,236

[22] Filed: Nov. 14, 1977

[51] Int. Cl.[2] ..... E01C 19/22

[52] U.S. Cl. ..... 404/118; 404/104

[58] Field of Search ..... 404/118, 119, 104, 101, 404/114

[56] References Cited

U.S. PATENT DOCUMENTS

| | | | |
|---|---|---|---|
| 2,848,930 | 8/1958 | Thompson | 404/104 |
| 3,031,938 | 5/1962 | Bero | 404/104 |
| 3,557,672 | 1/1971 | Shurtz | 404/118 X |
| 3,572,227 | 3/1971 | Poulsen | 404/118 |
| 3,680,451 | 8/1972 | Birtchet | 404/104 |
| 3,907,451 | 9/1975 | Fisher | 404/118 X |
| 3,957,384 | 5/1976 | Lamb | 404/118 |
| 3,992,124 | 11/1976 | Schrader | 404/118 |

*Primary Examiner*—Nile C. Byers, Jr.
*Attorney, Agent, or Firm*—Allison C. Collard; Thomas M. Galgano

[57] ABSTRACT

A mounting bar for a road making machine having adjuster bars which are pushable out laterally to adjust the working width and which are arranged behind a main bar. Guide tubes for guiding the adjuster bars for telescopic extension are movably supported on the main bar by connection means for movement in the direction of extension of the adjuster bars. The conection means is arranged between the main bar and an end of each guide tube remote from the adjuster bar.

8 Claims, 2 Drawing Figures

MOUNTING BARS FOR ROAD MAKING MACHINES

BACKGROUND OF THE INVENTION

1. Field of the Invention

The invention relates to mounting bars for road making machines. In such bars, for adjustment of the working width, laterally extendable adjuster bars may be arranged behind a main bair, telescope-like extendable guide tubes being provided which are supported on the main bar, for guiding the adjuster bars.

2. Description of the Prior Art

A mounting bar of the kind referred to is already known from the German Gebrauchsmuster 74 34 220. In the known mounting bar tubes serving as guides are rigidly arranged on the main bar and support rods or support tubes which are flush therewith and are attached to the adjuster bars are displaceably guided therein. In order to obtain an increase of the working width of the main bar, the adjuster bars are laterally extended, the support tubes or support rods being pulled thereby out of the guide tubes.

The known construction has the disadvantage that the support rods cannot be pulled too far out of the guide tubes, because reliable guidance is no longer ensured as soon as the support rods are guided by a guide surface when then amounts to only approximately one third of the length of the guide tubes.

Therefore the full length of the support rods or support tubes and of the guide tubes on the main bar cannot be utilised for the adjustment of the working width of the mounting bar.

SUMMARY OF THE INVENTION

According to the invention, there is provided a mounting bar for a road making machine, having adjuster bars for adjusting working width which may be pushed out laterally and which are arranged behind a main bar, and guide tubes for guiding the adjuster bars for telescopic extension, the guide tubes being movably supported on the main bar by a connection for movement in the direction of extension of the adjuster bars, the connection being, arranged between the main bar and an end of each guide tube remote from the adjuster bar.

In a preferred mounting bar, adjustment of the working width becomes possible over a relatively large range.

It is possible thereby to enlarge the width adjustment range of a mounting bar, in that e.g. when a displacement point of the telescope sections is reached at which a secure guidance is no longer ensured, the entire guide tube can be moved still further relatively to the main bar. The relative displacement path to the main bar increases the adjustment range. Moreover the movable connection between the guide tube and the main bar has the further advantage that the extension possibilities of the telescopable sections of the guide tubes need not be fully exploited in every case, whereby the guidance by the guide tubes becomes considerably more rigid and secure.

Preferably the guide tubes extend a mounting bar for a road making machine, having adjuster bars for adjusting working width which may be pushed out laterally and which are arranged behind a main bar, and guide tubes for guiding the adjuster bars for telescopic extension, the guide tubes being movably supported on the main bar by a connection for movement in the direction of extension of the adjuster bars, the connection being arranged between the main bar and an end of each guide tube remote from the adjuster bar. The relatively strong guide tubes from which tube sections may be pulled out which support or guide the adjuster bar and which may be telescoped, are movably connected to the main bar by way of the common base plate as well as by way of the slide bearings in the side wall.

In order also to guide an end of each adjuster bar facing the main bar guide, members are provided at the adjuster bar which are displaceable in slide bed-like guides of the main bar. The slide bed-like guides of the base plate of the guide tubes and of the end of each adjuster bar facing the main bar, may be constructed as guide grooves. The guide grooves may advantageously be provided with play adjusting elements for the purpose of compensating manufacturing and assembly tolerances. Thereby, an adjustment even during the later production employment of the mounting bar is rendered possible, when a reliable guidance appears to be no longer ensured owing to wear effects. The play adjusting elements may be constructed as clamping members which are adjustable by means of screws.

The guidance of the adjuster bars at the main bar may be improved further in that the upper parts of the main bar and of the adjuster bars may comprise head sections which extend beyond their lower mounting surfaces and which project towards each other, thereby overlapping each other, the guide tubes and guides being disposed in other regions of the head sections corresponding to the largest possible bar width.

This construction of the mounting bar has the advantage that the main bar and the adjuster bars are arranged relatively closely together. Owing to the forwardly extending head sections of the main bar as well as the adjuster bar, the guide tubes are likewise disposed advantageously at a large spacing from each other, whereby tilting moments about the longitudinal axis of the mounting bar, which may possibly occur and which may occur e.g. when the ground is uneven, cannot lead to twisting. The main bar together with its adjuster bars is grouped together to form a relatively strong mounting bar, wherein the adjuster bars are guided so securely that, upon enlargement of the working width, no disadvantages need be expected in respect of the level control of the road coverings to be assembled.

For adjusting the working width or for the displacement of the adjuster bars, displacer cylinders operable by means of pressure means may be provided, the pistons of which may engage, for instance, at the adjuster bar. A so-called double acting cylinder may be employed in this case; however, alternatively, separate cylinders may be used respectively for extending and retracting the adjuster bars.

DESCRIPTION OF THE PREFERRED EMBODIMENTS

Figure 1:
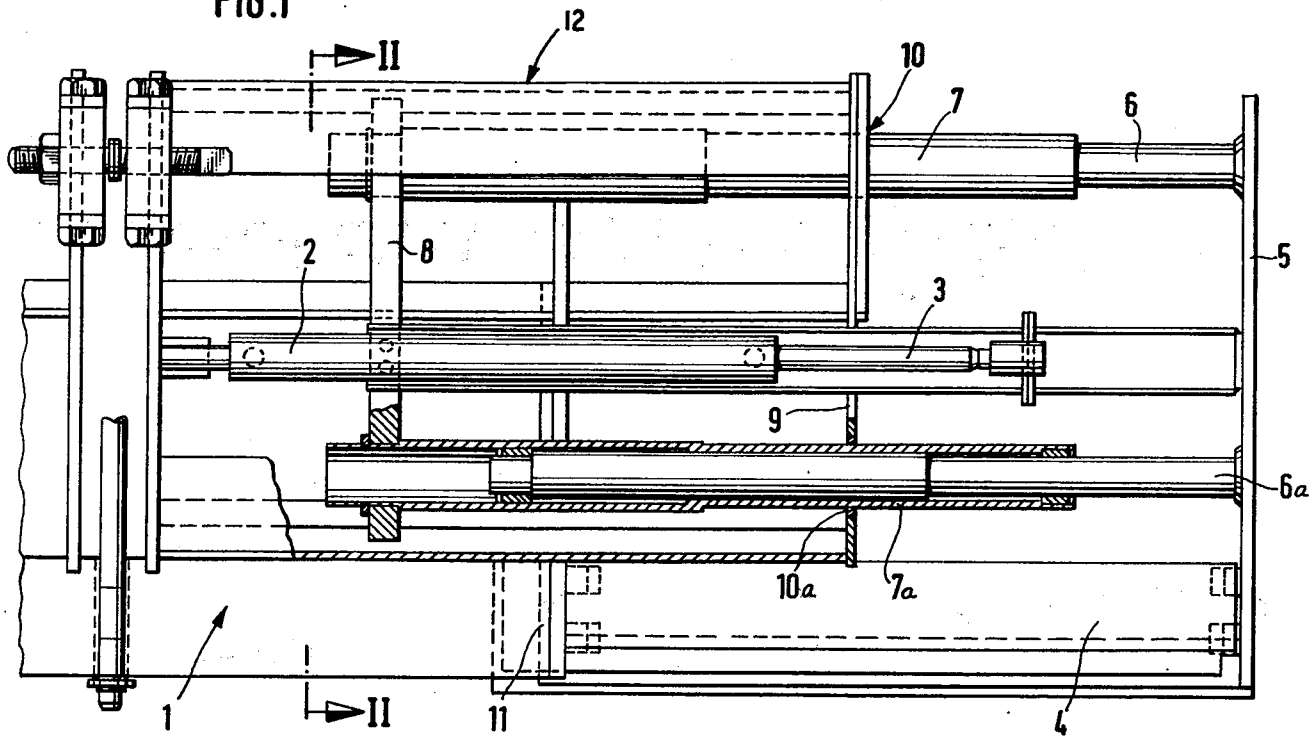
FIG. 1 is a view from above of one half of a preferred mounting bar.

FIG. 1 illustrates one half of a mounting bar in a view from above. It consists of a main bar 1 on which a hydraulic cylinder 2 is supported having a piston rod 3 by means of which an adjuster bar 4 can be pushed laterally out of the main bar. An outer side wall 5 of the adjuster bar 4 has support tubes 6 and 6a attached thereto which may be pulled out of guide tubes 7 and 7a in a telescope-like manner when the adjuster bar is displaced relatively to the main bar 1 by means of the hydraulic cylinder 2 with the piston 3. The ends of the guide tubes 7 and 7a are connected together by means of a common base plate 8. This base plate is movably guided in the main bar 1 so that the guide tubes themselves can be displaced together with the adjuster bar 4 also for adjusting the working width. A side wall 9 of the main bar is provided with slide bearings 10 and 10a supporting the guide tubes 7 and 7a. The end of the adjuster bar facing the main bar has an inner side wall 11 and is likewise guided at the main bar 1 by means of corresponding guide elements.

Figure 2:
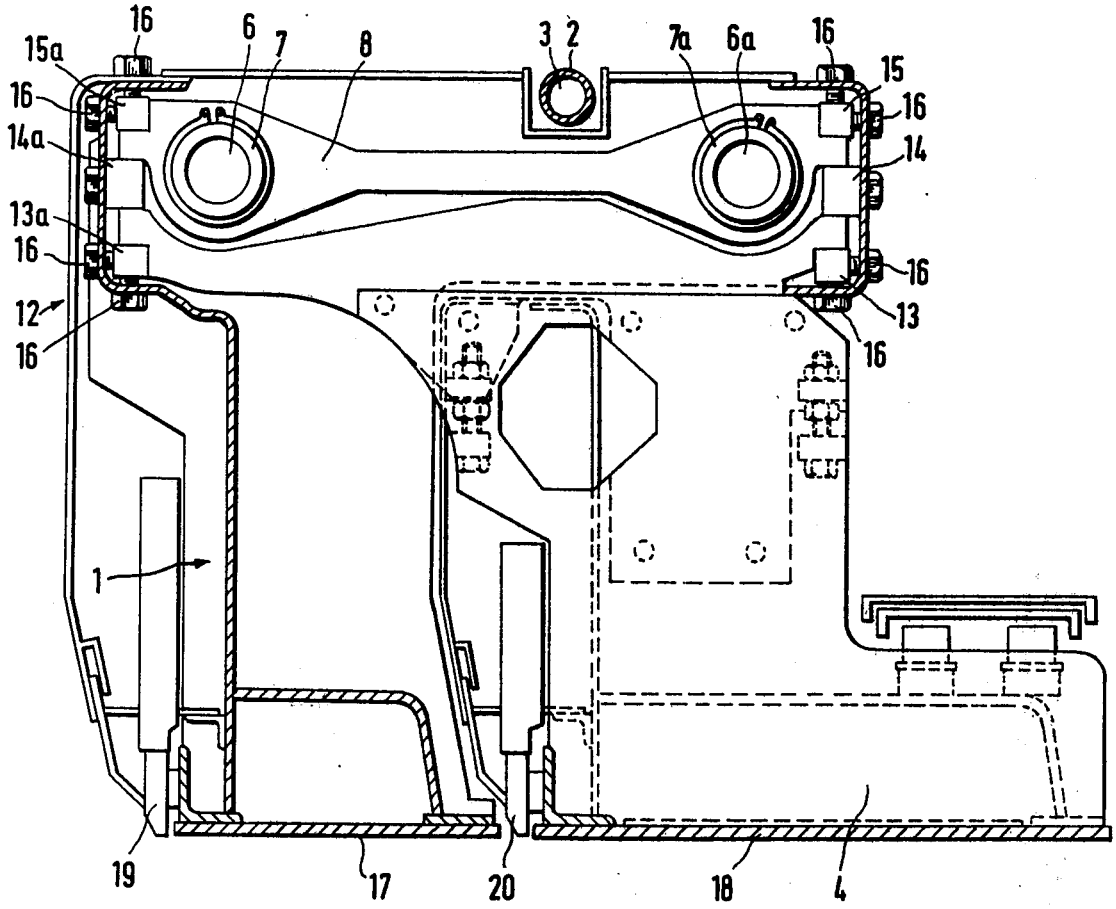
FIG. 2 is a cross section of the mounting bar taken along line II of FIG. 1.

FIG. 2 illustrates a cross-sectional view of the mounting bar according to FIG. 1. Similar construction components are provided with the same reference numerals. It is shown that the main bar 1 comprises a generally hollow, rearwardly-projecting head portion and that also the adjuster bar 4 comprises a projecting head portion which projects forwardly and which is extended nearly to the forward longitudinal wall 12 of the main bar. The head portions of the adjuster bar 4 and the main bar 1 overlap each other, slide rails 13, 13a, 14, 14a and 15, 15a extending in the longitudinal direction of the bars and serving as guide elements being arranged at their respective outer ends. Whereas the adjuster bar is always guided between the slide rails 13, 14 and 13a, 14a, respectively, guidance of the base plate 8 is effected between the slide rails 14 and 15 or 14a and 15a, respectively.

In order to be able to adjust play between the slide rails and to ensure accurate guidance even after wear, the slide rails 13 and 15, or 13a and 15a, respectively, are adjustable by means of clamping screws 16 in a horizontal as well as in a vertical direction.

The lower mounting surfaces of the bars are denoted by 17 and 18, associated stamping blades being additionally marked by 19 and 20.

What is claimed is:

1. A device for adjusting the working width of a road making machine comprising:

a main bar having an elongated front wall and two lateral ends;

a pair of adjuster bars disposed rearwardly of said front wall of said main bar, each of which is associated with an opposite end of said main bar and which is reciprocably movable laterally away from and toward said associated end of said main bar so as to serve as an extension for said main bar and to cooperate therewith for adjusting the working width;

at least one pair of guide tubes each of which is associated with an opposite end of said main bar and in each of which one of said adjuster bars is at least partially and telescopically received and supported therein for reciprocal sliding movement and telescopic extension and retraction from one end thereof; and mounting means for slidably mounting said guide tubes on said main bar for lateral reciprocal movement in the same direction of extension and retraction of the adjuster bar supported therein, and mounting means being coupled between said main bar and an end of said tubes remote from said one end thereof, said slidable guide tubes cooperating with said adjuster bars and said main bar for adjusting the working width.

2. The device according to claim 1, wherein said device includes an additional pair of said guide tubes, wherein said guide tubes associated with the same end of said main bar are disposed parallel to one another, wherein said mounting means includes a common base plate for each of said guide tubes associated with the same end of said main bar which is fixed to said remote end of said tubes and slide bed-like plate guides mounted on said main bar which slidably support said common base plates and extend in the same direction of extension and retraction as the adjuster bar supported in said guide tubes coupled thereto and wherein said main bar includes two side walls each having slide bearings, each of which slidably support said guide tubes associated with the same end of said main bar.

3. The device according to claim 2, wherein each of said adjuster bars each include guide members and said main bar has slide bed-like guides in which said guide members are displaceable.

4. The device according to claim 3, wherein said slide bed-like guides in which said guide members are displaceable comprise spaced-apart guide rails between which said guide members are displaceable.

5. The device according to claim 4, additionally including play adjusting means for adjusting the position of said guide rails.

6. The device according to claim 5, wherein said play adjusting means includes adjustable clamping screws which support said rails on said main bars.

7. The device according to claim 4, wherein said main bar has a generally hollow upper head portion having a forward end wall and a rearward end wall on which said guide rails are mounted, wherein said adjuster bars each have an upper head section having a forward end and a rearward end on which said guide members are provided and wherein said guide tubes associated with the same end of said main bar are at least partially disposed within said hollow upper head section of said main bar, one of which is adjacent to the forward end wall thereof and the other of which is adjacent to the rearward end wall thereof.

8. The device according to claim 1, additionally including at least one displacement cylinder operable by pressure means coupled between said main bar and each of said adjuster bars.

* * * * *